US007343947B1

(12) United States Patent
Sollami

(10) Patent No.: US 7,343,947 B1
(45) Date of Patent: Mar. 18, 2008

(54) RETAINER FOR A ROTATABLE TOOL

(75) Inventor: Phillip A. Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 314 days.

(21) Appl. No.: 10/988,756

(22) Filed: Nov. 15, 2004

(51) Int. Cl.
*B27G 13/00* (2006.01)

(52) U.S. Cl. ..... 144/241; 299/107

(58) Field of Classification Search ..... 144/218, 144/241; 407/30, 34, 40, 46–50, 53; 299/101–109, 299/111, 86, 91
See application file for complete search history.

(56) References Cited

U.S. PATENT DOCUMENTS 3,663,063 A * 5/1972 Johnmeyer, Sr. ..... 299/107
3,957,307 A * 5/1976 Varda ..... 299/106
4,743,069 A * 5/1988 Ojanen ..... 299/107
4,755,003 A * 7/1988 Pinkerton et al. ..... 299/107
4,763,956 A * 8/1988 Emmerich ..... 299/107
5,067,775 A 11/1991 D'Angelo
6,623,084 B1 * 9/2003 Wasyleczko ..... 299/107

* cited by examiner

*Primary Examiner*—Shelley M. Self
(74) *Attorney, Agent, or Firm*—Robert L. Marsh

(57) ABSTRACT

The cylindrical shank of a rotatable tool is retained in the cylindrical bore of a tool holder by a retainer that engages an annular groove on a portion of the shank of the tool that extends outward of the rear surface of the tool holder. The tool has an axial bore in the distal end of the shank. The retainer has a pair of spaced ridges that engage the annular groove on the shank and a panel that extends across the distal end of the shank. The retainer is held in place by a pin extending through the panel and into the bore in the distal end of the shank.

12 Claims, 5 Drawing Sheets

RETAINER FOR A ROTATABLE TOOL

The present application relates to rotatable tools mounted on a drum for mulching up large discarded objects such as tree trunks, boat hulls, and the like, to reduce them to chunks of material small enough for recycling or the like.

BACKGROUND OF THE INVENTION

Mulching machines for mulching wood and machines for shredding objects such as boat hulls and tree trunks have a rotatable drum with a plurality of cutting tools mounted on the drum. The cutting tools are symmetric about a longitudinal axis and have a tapered forward cutting end for shredding the material and a cylindrical shank that is rotatably mounted in the cylindrical bore of a tool holder on the machine. The tool must be mounted to rotate as the machine operates so that the tapered forward cutting end of the tool wears evenly around its circumference. If the tool fails to rotate, the tool will wear unevenly and its useful life will be significantly shortened. When a number of tools on the machine become worn, the machine must be taken out of service and the damaged tools removed and replaced.

The machines that mulch up bulky material have drums that rotate rapidly such that the surface speed of the drum is as high as six thousand feet per minute. If the rotating teeth on the drum encounter a particularly hard substance, such as a rock or large piece of metal, the impact may suddenly stop the rotation of the drum. When the drum jams, the tools mounted on the periphery of the drum are decelerated in a fraction of a second and as a result, a powerful force is applied to pull the tool out of the tool holder.

In the past, it has been the practice to retain such tools in the tool holders of the machines by providing a deep groove around the circumference of the shank of the tool and fitting spring pins through the tool holder so as to engage the groove in the shank and thereby retain the shank into the tool holder. It has been found, however, that over a period of time the forward end of the tool holder becomes worn away by a radial flange on the tool as the tool rotates. The results of the wearing of the forward surface of the tool holder is that the shank of replacement tools fits deeper into the bore of the tool holder and the annular groove on the shank is no longer aligned with the spring pin that retains the tool in the tool holder. The consequence is that continued rotation of the tool causes the spring pin to be worn away. As a result, the instance of tool failure, where the tool is lost out of its retainer, occurs more frequently as the tool holders of the machine become worn.

It would be desirable, therefore, to provide an improved tool holder that would retain the tool against a strong force pulling the tool out of the holder. It would also be desirable to provide a tool holder that would not become compromised as the tool holders of the machine become worn.

SUMMARY OF THE INVENTION

Briefly, the present invention is embodied in a retaining device for a rotatable tool. The rotatable tool is of the type mounted on a rotating drum of a machine where the tool has a tapered forward end for cutting hard objects and axially aligned behind the tapered cutting end is a generally cylindrical shank. Between the tapered forward cutting end and the cylindrical shank is a radial flange having a generally planar annular rearward surface from which the cylindrical shank projects.

In accordance with the invention, the cylindrical shank has a length that is longer than the bore in the tool holder through which the shank is fitted. The cylindrical shank has an annular groove on the portion of the distal end thereof that extends outward of the rearward end of a tool holder. To retain the tool in the tool holder, a tool retainer is provided having a metal body that includes an arcuate metal ridge that engages the annular groove projecting from the rearward surface of the tool holder. The retainer further has a panel that extends across the rearward surface at the distal end of the shank of the tool.

An axial hole extends into the transverse surface at the rearward end of the shank, and a second hole extends through the panel that fits across the rearward surface and is aligned therewith. To retain the parts together, a pin is inserted through the hole in the panel of the retainer and into the axial hole at the distal end of the shank where it is retained therein by any suitable means. The pin may be a spring pin, a compression pin, a threaded pin, or may have any other retention method suitable to retain the pin and thereby retain the parts together.

In accordance with the invention, the axial hole at the distal end of the shank has a depth that is at least equal to the length of the pin. Accordingly, when the tool in the tool holder becomes worn and it is desirable to remove and replace the tool, the pin may be pounded deeper into the axial hole with a hammer until it no longer engages the retainer. Once the pin no longer engages the retainer, the retainer, including the annular portion that extends into the groove of the shank, can be removed, thereby allowing removal of the tool from the tool holder.

The fundamental elements of the invention include a cylindrical shank on the tool that has a length greater than the length of the cylindrical bore through which the shank extends, an annular ridge around the portion of the distal end of the shank which extends outward of the rearward end of the tool holder when the tool is inserted therein, and an axial bore at the distal end of the shank of the tool. The tool holder for retaining the tool includes a tool body having parallel spaced members that engage the annular groove at the distal end of the shank and a panel that extends across the distal end of the shank with a hole therein that is aligned with the axial hole in the distal end of the shank of a tool. Finally, the invention includes a suitable retaining pin that can fit through the hole in the panel while it is positioned across the distal end of the shank, and into the axial hole in the distal end of the shank of the tool to keep the parts in alignment while the tool is in use.

In another embodiment of the invention, the pin that retains the parts in alignment and thereby retains the retainer to the distal end of the shank may be in the form of a bolt that extends through an unthreaded hole in the rearward panel of the retainer and into complementary threads in the hole at the distal end of the shank of the tool.

In yet another embodiment of the invention, the pin may be partially inserted into the axial hole at the distal end of the tool by the manufacturer. In this embodiment, the retainer has an arcuate forward portion that engages the annular groove near the end of the tool shank and a panel that extends across the end of the shank, however, the panel has an elongate slot therein shaped to receive the pin as the parallel members engage the slot on the shank. In this embodiment, the slot in the panel is configured to snap around the end of the pin to hold the retainer in place.

BRIEF DESCRIPTION OF THE DRAWINGS

A better understanding of the invention will be had after a reading of the following detailed description taken in conjunction with the drawings where.

DETAILED DESCRIPTION OF A PREFERRED EMBODIMENT

Figure 1:
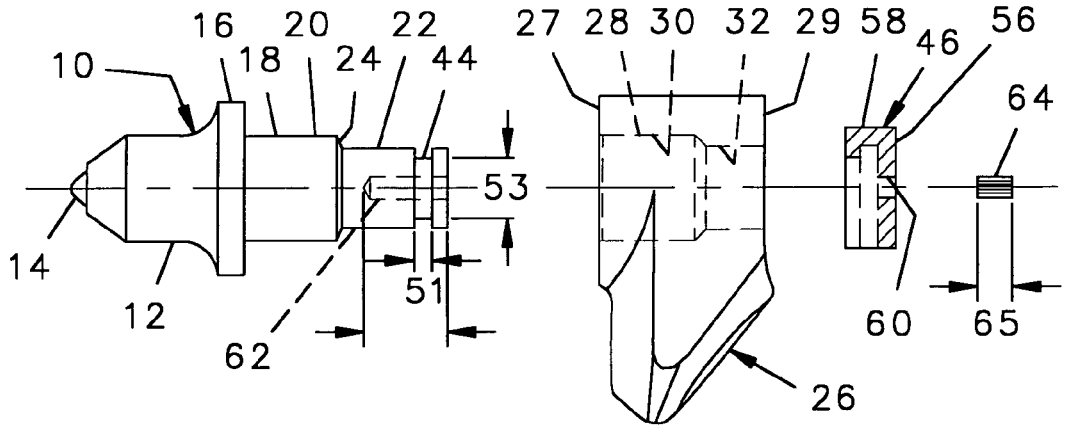
FIG. 1 is an exploded side elevational view of a tool, tool holder and retainer in accordance with the present invention, with the retainer shown in cross-section and the inner parts of the tool and tool holder shown in broken lines.
Figure 2:
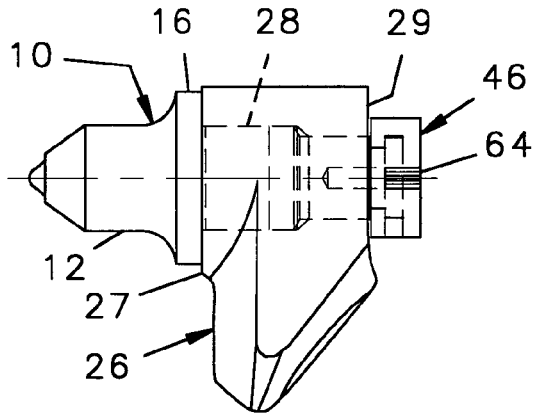
FIG. 2 is a side elevational view of the assembled parts shown in FIG. 1 with the inner portions thereof shown in broken lines.
Figure 3:
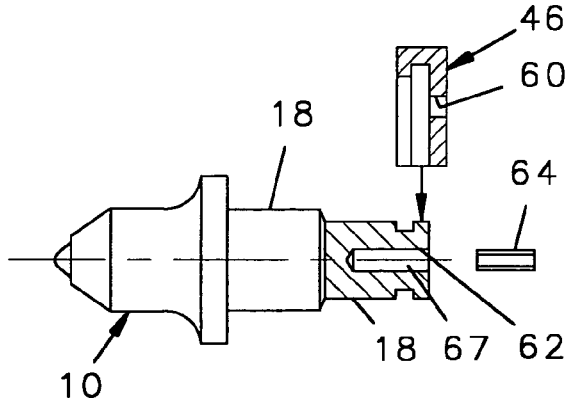
FIG. 3 is a side elevational view, partly in cross-section of the tool and retainer shown in FIG. 1.
Figure 4:
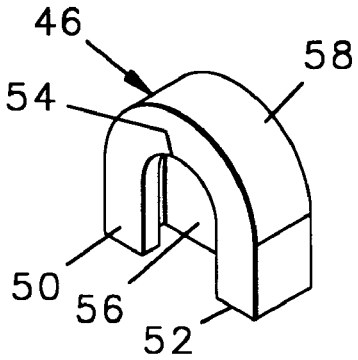
FIG. 4 is an isometric view of the retainer shown in FIG. 1.
Figure 5:
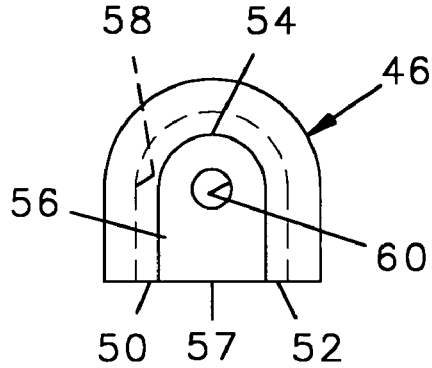
FIG. 5 is a front elevational view of the retainer shown in FIG. 4.

Referring to FIGS. 1, 2 and 3, a tool 10 has a generally conical forward cutting end 12 at the forward end of which is a hardened tip 14 for cutting up material. Rearward of the forward cutting end 12 is an enlarged diameter radial flange 16 and rearward of the radial flange 16 is an axially aligned generally cylindrical shank 18. The shank 18 may have a single diameter along its entire length, or may have a first large diameter 20 and rearward of the large diameter 20, a second smaller diameter portion 22 with the larger and smaller diameter portions joined by a shoulder 24 as shown.

The tool 10 is retained in a tool holder 26 having forward surface 27, a rearward surface 29, and extending through the forward and rearward surfaces 27, 29, a transverse bore 28. The bore 28 has first and second inner diameters 30, 32 that are a little larger than the large diameter 20 and small diameter 22 portions respectively, of the shank 18 and are positioned to retain the full length of the shank as shown. The tool 10 is adapted to rotate within the bore 28 of the tool holder 26 thereby causing the tool 10 to be worn symmetrically about its longitudinal axis to thereby maximize its useful life. If for any reason the tool 10 fails to rotate, the tool will become unevenly worn and this will result in the premature failure of the tool.

To retain a tool in the tool holder, it has been common to provide tools with an elongate shank 18 that extends beyond the rearward surface 29 of the tool holder 26 and to provide an annular groove 44 in the distal end of the shank 18 where it can be engaged by a removable clip or the like having an outer dimension larger than the diameter of the portion of the bore extending through the rear surface 29. It has been found, however, that it is difficult to provide an adequate attachment to hold such retainers to the distal end of the shank.

Figure 6:
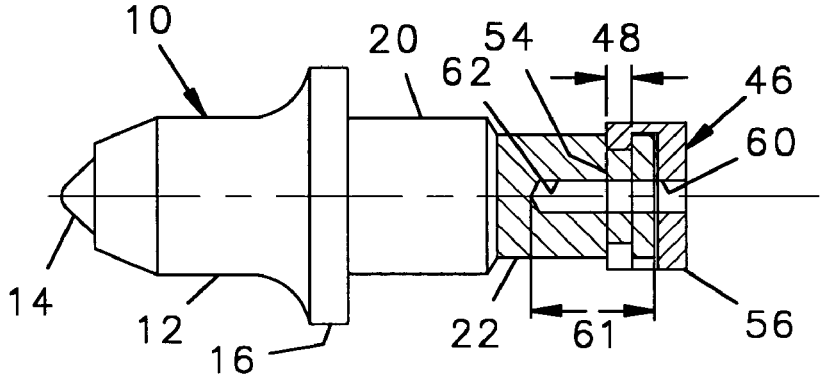
FIG. 6 is a side elevational view, partly in cross-section, of the tool shown in FIG. 1 with the retainer shown in FIG. 4 assembled thereto.
Figure 7:
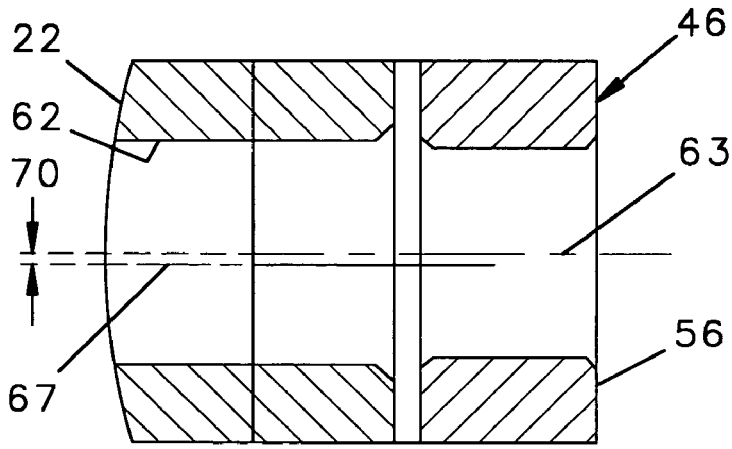
FIG. 7 is an enlarged, fragmentary cross-sectional view showing the alignment of the end of the tool shank and the retainer shown in FIG. 6.

Referring to FIGS. 1 through 6, a retainer 46 in accordance with the invention for attachment in the groove 44 at the distal end of the shank 18 includes a metal body having a horseshoe shaped forward portion with first and second parallel legs 50, 52 spaced apart a distance a little greater than the inner diameter 53 of the second groove 44 with the legs 50, 52 joined together by an arcuate portion 54. The thickness 48 of the forward portion 50, 52, 54 is a little less than the axial length 51 of the annular groove 44 such that the legs 50, 52 can slideably engage into the groove 44 until the arcuate portion 54 becomes also engaged with a complementarily-shaped portion of the groove as depicted in FIG. 6.

At the rearward end of the retainer 46 is a rear panel 56 having an outer shape that is complementary to the outer perimeter of the forward portion (50, 52, 54). The rear panel 56 is spaced from the forward portion (50, 52, 54) by a web portion 58 such that the rear panel 56 will fit across the distal end of the shank 18 of the tool 10 when the legs 50, 52 and arcuate portion 54 of the forward portion 48 (50, 52, 54) are engaged with the groove 44 of the shank 18. The web 58 joins the legs 50, 52 and the arcuate portion 54 of the forward portion to the rear panel 56 leaving one end 57 of the rearward panel unattached by the web 58. The open end 57 of the web 58 enables the retainer 46 to receive the distal end of the shank 18 of the tool 10 as the legs 50, 52 are fitted into the groove 44 of the shank 18 of the tool 10.

Extending through a central portion of the rear panel 56 is a transverse hole 60. Also extending into the distal end of the shank 18 of the tool 10 is an axial bore 62. To secure the retainer 46 to the distal end of the shank 18 of the tool, a suitable retaining pin 64 is inserted through the transverse hole 60 of the retainer 46 and into a portion of the axial hole 62 at the distal end of the tool 10 as best shown in FIG. 2.

One feature of the invention is that the depth 61 of the axial bore 62 is at least equal to the overall length 65 of the pin 64. The tools 10 of the machines become worn over time and periodically must be replaced. When tool replacement is necessary, the pin 64 is driven by a hammer and punch deeper into the axial bore 62 at the distal end of the shank, until it no longer engages the rear panel 56 of the retainer 46. Thereafter, the retainer 46 can be easily removed from the shank of the tool and the tool removed from the tool holder 26.

It should be appreciated that any suitable retaining pin 64 may be used to maintain the retainer 46 on the distal end of the shank 18. For example, the retaining pin 64 may be a spring loaded pin, as is depicted in FIG. 3, which is only available in certain forms of steel, or may be a solid alloy pin such as manufactured by Driv-Lok, Inc. and depicted in FIGS. 1 and 2.

Also, as best shown in FIGS. 3, 4, 5 and 7, to tightly secure the retainer 46 to the rear end of the tool 10, the axis 63 of the transverse hole 60 in the rear panel 56 of the retainer is a little closer to the arcuate portion 54 than to the center of groove 44 at the rear of the shank 18 of the tool 10. Accordingly, when the retainer 46 is fitted on the distal end of the tool 10 with the forward portion 50, 52, 54 fitted into the groove 44, the center line 63 of the transverse hole 60 in the rear panel 56 will be misaligned with respect to the center line 67 of the axial bore 62 in the shank of the tool 10 by a small distance. Where the retainer 46 is made of a hardened or soft steel, the misalignment 70 is preferably about 15 thousandths inch. With the small misalignment as shown, the insertion of the pin 64 causes the steel of the retainer 46 to become slightly distorted and causing the arcuate portion 54 of the retainer 46 to be tightly wedged into the second groove 44 and thereby tightly secures the retainer 46 to the distal end of the shank 18 of the tool 10.

Figure 8:
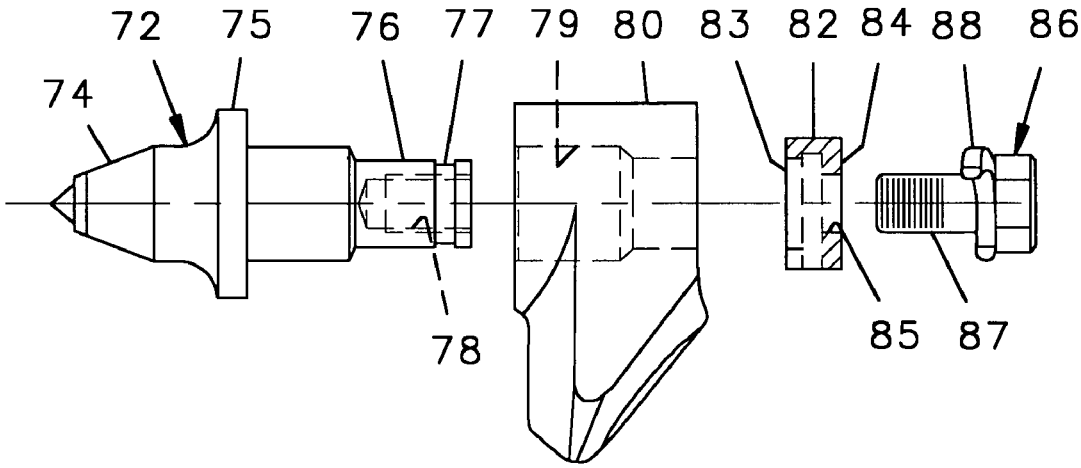
FIG. 8 is an exploded view of a tool, tool holder, retainer, and bolt in accordance with another embodiment of the invention with the retainer shown in cross-section and the inner portions of the tool and tool holder shown in broken lines.
Figure 9:
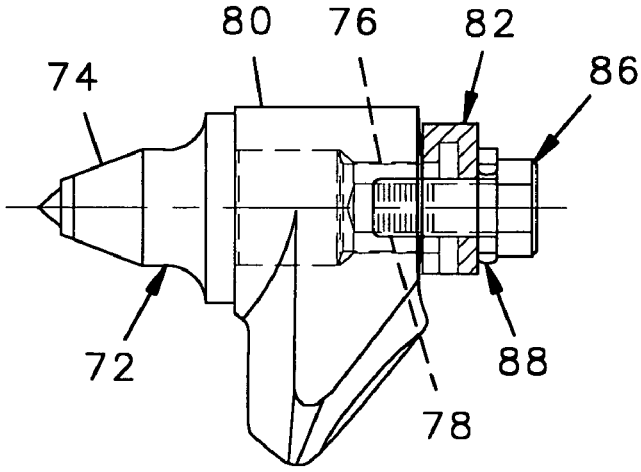
FIG. 9 shows the parts depicted in FIG. 8 in assembled relationship.
Figure 10:
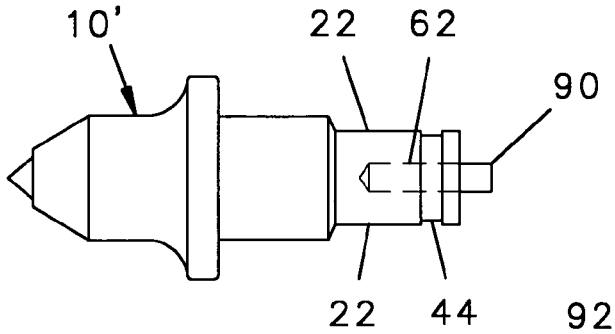
FIG. 10 shows a side elevational view with the inner parts shown in broken lines of a tool with a retaining pin assembled thereto for use with a retainer in accordance with another embodiment of the invention.

Referring to FIGS. 8, 9, and 10, another embodiment of the invention is attachable to a tool 72 having a tapered cutting end 74 behind which is a radial flange 75 and an axially extending shank 76, and around the distal end of the shank 76 is an annular groove 77 similar to the parts described with respect to the tool 10. The tool 72 differs from the tool 10 in that it has an axially extending threaded bore 78 extending into the distal end of the shank 76.

The tool 72 is received in the bore 79 of a tool holder 80 similar to the tool holder 26 described above, and is retained in the tool holder 80 by a retainer 82 in accordance with the present invention. The retainer 82 has a horseshoe shaped forward portion 83 with a thickness sized to engage the annular grove 77 of the tool 72 and a rear panel 84 that extends across the distal end of the shank 76 similar to the forward portion 50, 52, 54 and the rear panel 56 of retainer 46. However, the hole 85 extending through the rear panel 84 is sized to slideably receive the threaded shank 87 of a bolt 86. The threads of the bolt 86 are received into the threaded bore 78 of the tool 72. A lock washer 88 around the shank 87 of the bolt 86 retains the bolt 86 tightly in the bore 78 of the tool 72. In this embodiment, the retainer 82 must be removed from the tool 72 by unthreading the bolt 86 and removing it from the hole 78.

Figure 11:
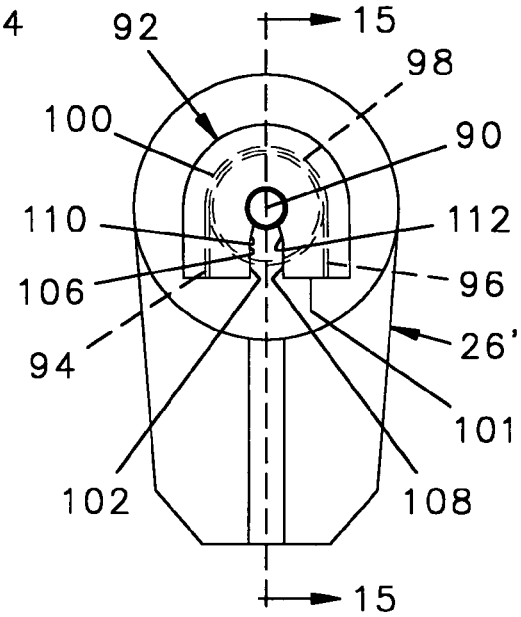
FIG. 11 shows the tool and retaining pin shown in FIG. 10 with a retainer in accordance with the embodiment useable therewith.
Figure 12:
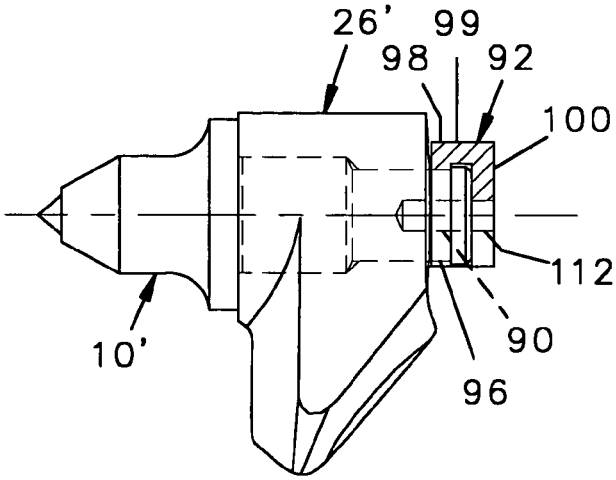
FIG. 12 is a side elevational view, partially in cross-section and partially showing inner parts in broken lines of the embodiment shown in FIGS. 10 and 11.

Referring to FIGS. 10, 11 and 12, in which another embodiment of the retainer 92 is depicted attached to a tool 10' having parts identical to what has been described above and depicted in FIGS. 1 through 7 and bear like indicia numbers. In this embodiment the manufacturer has delivered the tool 10' to a customer with a spring pin 90 mostly inserted into the axial bore 62 at the distal end of the shank 22 of the tool 10'. The spring pin 90 has a unconstricted diameter that is about 5 percent larger than the nominal diameter assigned of the spring pin 90, and the axial bore 62 is made equal to the nominal diameter of the spring pin 90 such that the spring pin is tightly retained within the bore 62.

A retainer 92 in accordance with this embodiment is generally configured similar to the retainer 46 and includes a horseshoe-shaped forward portion with first and second legs 94, 96 and an arcuate portion 98 joining the inner ends of the legs 94, 96. The legs 94, 96 and arcuate portion 98 are sized and shaped to engage the groove 44 at the distal end of the shank of the tool 10'. Rearward of the horseshoe-shaped forward portion and spaced therefrom is a rearward panel 100 similar to the rearward panel 56 of retainer 46 described above. A web 99 joins the legs 94, 96, and the arcuate portion 98 to three sides of the rearward panel 100 leaving one end 101 of the panel unattached to the web 99.

The retainer 92 differs from the retainer 46 in that the rearward panel 100 has an elongate slot 102 therein with the sides 106, 108 of the slot 102 extending generally parallel to the inner surfaces that define the legs 94, 96 and opening at the end 101 of the rear panel 100 opposite the arcuate portion 98. The sides 106, 108 of the slot 102 are spaced apart a distance to receive the end of the spring pin 90 there between when the legs 94, 96 of the retainer 92 are fitted into the groove 44 of the tool 10 as shown in FIGS. 11 and 12. The sides 106, 108 of the slot 102 also have protrusions 110, 112 respectively that form a constriction in the slot 102 which is narrower than the constricted diameter of the spring pin 90. Accordingly, when the retainer 92 is fitted with the legs 94, 96 in the slot 44 of the tool 10', and force is applied to the arcuate end 98 of the retainer 92, the portion of the spring pin 90 extending out of the bore 62 will become momentarily further compressed allowing it to snap through the protrusions 110, 112 after which the retainer 92 will be retained to the shank 18 of the tool 10. A retainer 92 can thereafter be unsnapped from the distal end of the tool 10 without requiring a technician to have axial access to the distal end of the shank 18.

Although this embodiment is depicted as including a spring pin 90 inserted into the distal end of the tool 10', it should be appreciated that any compressible member on either the distal end of the shank of a tool or on the rear panel 100 of the retainer 92 that engages an indentation or protrusion on the mating surface of the other will fall within the spirit of the invention. For example, a retainer having a horseshoe shaped forward retaining portion and a parallel, somewhat flexible, rear surface joined thereto by a web as described with respect to other embodiments, and the rear panel has an inwardly extending centrally located projection that can be snapped into an indentation at the distal end of the shank of the tool falls within the spirit of this invention.

Figure 13:
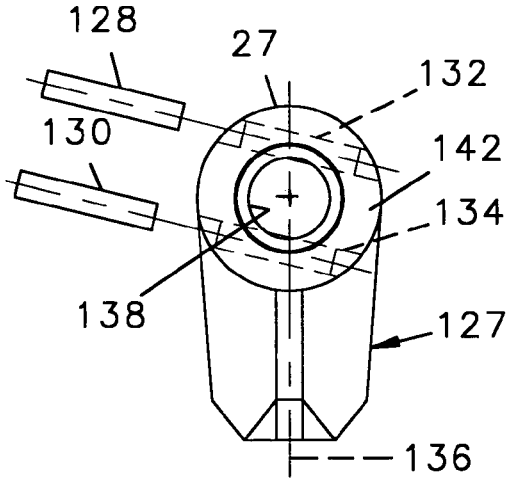
FIG.13 PRIOR ART
FIG. 13 is a front elevational view of a tool holder and spring pins in accordance with the prior art.
Figure 14:
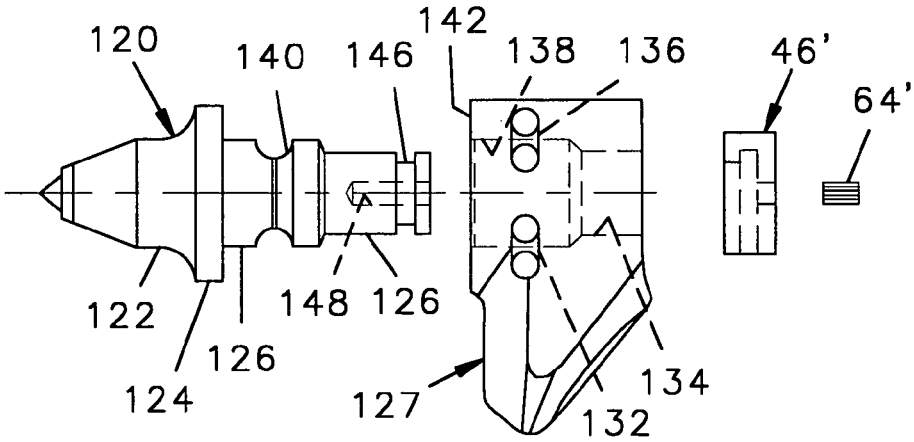
FIG. 14 is an exploded side elevational view of a tool holder and retainer for use with the tool holder shown in FIG. 13 with the inner parts shown in broken lines.
Figure 15:
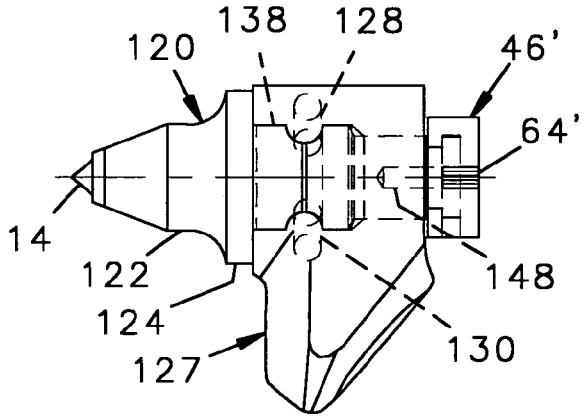
FIG. 15 is an assembled side elevational view of the parts as shown in FIG. 14.

The invention is useable as a supplemental retainer to retain tools retained in tool holders using certain prior art retention means. Referring to FIGS. 13, 14, and 15, a tool 120 having a tapered cutting end 122, a radial flange 124 and a cylindrical shank 126 is retained in a prior art tool holder 127 by a pair of spring pins 128, 130. The spring pins 128, 130 are received in parallel spaced apart tangential holes 132, 134 that extend equally spaced from the axis 136 of the bore 138 of the tool holder 127. The shank 126 of the tool 120 has an annular groove 140, the central plane of which is spaced from the rear surface of the radial flange 124 a distance equal to the distance that the axis of the holes 132, 134 are spaced from the forward surface 142 of the tool holder 127. Accordingly, where the shank 126 of the tool 120 is inserted in the bore 138 of the tool holder 127, and the spring pins 128, 130 are inserted in the holes 132, 134, the central portions of the spring pins 132, 134 will engage the groove 140 of the shank 126 of the tool 120 and rotatably retain the tool 120 in the tool holder 127.

The use of spring pins 128, 130 permits the tool 120 to rotate about its longitudinal axis as the machine operates. It has been found, however, that the use of such spring pins to retain tools on a high speed machine has been unsatisfactory for several reasons. First, the tools are mounted on the outer circumference of a drum that may rotate so rapidly that the tips of the cutting teeth of the tools move at about six thousand feet per minute. If the drum encounters a hard object, such as a rock or a large piece of metal that cannot be broken up by the tools, the drum will jam and the tools will be decelerated in a fraction of a second. The forces on the tools caused by rapid deceleration can be sufficient to sheer the spring pins 128, 130 and the tool 120 will be ejected from the tool holder 127.

The risk of failure of the spring pins is greater for a machine that has been used over a long period of time. As the machine is used and the tools 120 rotate within the tool holders 127, the rearward surface of the flanges 124 wears away the forward surface 142 of the tool holder 127 after which the spring pins 128, 130 will no longer align properly with the groove 140 in the shank of the tool. Continued use of the machine and the rotation of the tools 10 will cause the central portion of the spring pins 128, 130 to become worn away and more susceptible to breakage.

To further retain the tools 120 in the bore 138 of a tool holder 127, a retainer 46' in accordance with the present invention may be attached to the distal end of the shank 126 of the tool 120. In this embodiment, the shank 126 of the tool 120 has an annular groove 146 near the distal end of the shank 126. The retainer 46' is identical to the retainer 46 described above such that elements thereof need not be again described, and the horseshoe shaped forward portions thereof engage the groove 146 as was described with respect to tool 10. The shank 126 of the tool 120 is also provided with an axial bore 148 sized to tightly receive a retaining pin 64' that is identical to retaining pin 64.

While certain embodiments of the invention have been depicted, it will be appreciated that many modifications and variations may be made without departing from the true spirit and scope of the invention. It is, therefore, the intent of the appendent claims to cover all such variations and modifications that fall within the spirit and scope of the invention.

What is claimed is:

1. A retainer for retaining the cylindrical shank of a cutting tool in a cylindrical bore of a tool holder wherein said shank has a length greater than an axial length of said bore, said shank has a transverse distal end, an axial hole in said distal end, and an annular groove around said shank adjacent said distal end, said retainer comprising a pair of spaced apart members for engaging said groove in said shank, a panel for extending across at least a portion of said distal end of said shank, while said spaced apart members engage said groove, a web joining said spaced apart members to said panel, said panel having a hole therein, and a retainer member receivable in said hole in said panel and receivable in said axial hole.

2. The retainer of claim 1 wherein said axial hole is threaded and said retainer member is a bolt.

3. The retainer of claim 1 wherein said retainer member has a given length and said axial hole has a depth at least equal to said given length.

4. The retainer of claim 3 wherein said retainer member is a spring pin.

5. The retainer of claim 3 wherein said retainer is an alloy steel locking pin.

6. The retainer of claim 1 wherein said hole in said panel is sized to slideably receive said retainer member and said axial hole is sized to tightly receive said retainer member.

7. A retainer for retaining a cylindrical shank from being withdrawn from a cylindrical bore of a holder wherein said shank has a length greater than an axial length of said bore, said shank has a transverse distal end, an axial hole in said distal end, and an annular groove around said shank adjacent said distal end, said retainer comprising a pair of spaced apart members for engaging said groove in said shank, a panel for extending across at least a portion of said distal end of said shank while said spaced apart members are engaging said groove, a web joining said spaced apart members to said panel, a hole in said panel, and a retainer member receivable in said hole in said panel and into said axial hole in said distal end.

8. The retainer of claim 7 wherein said axial hole is threaded and said retainer member is a bolt for being threadedly received in said threaded hole.

9. The retainer of claim 7 wherein said axial hole has a given depth and said retainer member has a length that is less than or equal to said given depth.

10. The retainer of claim 9 wherein said retainer member is a spring pin.

11. The retainer of claim 9 wherein said retainer is an alloy steel locking pin.

12. The retainer of claim 7 wherein said hole in said panel is sized to slideably receive said retainer member and said axial hole is sized to tightly receive said retainer member.

* * * * *